United States Patent [19]

Webb

[11] 4,191,025

[45] Mar. 4, 1980

[54] FLUID SUPPLY SYSTEM FOR A DOMESTIC APPLIANCE

[75] Inventor: William M. Webb, Louisville, Ky.

[73] Assignee: General Electric Company, Louisville, Ky.

[21] Appl. No.: 921,427

[22] Filed: Jul. 3, 1978

[51] Int. Cl.[2] ..... F25C 1/00

[52] U.S. Cl. ..... 62/135; 62/340; 251/54

[58] Field of Search ..... 251/16, 23, 54; 62/340, 62/135; 137/501, 514.3

[56] References Cited

U.S. PATENT DOCUMENTS

| | | | |
|---|---|---|---|
| 1,005,713 | 10/1911 | Killin | 251/54 |
| 1,356,238 | 10/1920 | Taylor et al. | 137/219 |
| 1,736,938 | 11/1929 | Price | 137/220 |
| 2,469,038 | 5/1949 | Winkler | 236/92 |
| 2,580,433 | 1/1952 | Kain | 137/145 |
| 2,637,338 | 5/1953 | Troendle | 137/498 |
| 2,962,099 | 11/1960 | Clark, Jr. | 166/224 |
| 3,008,307 | 11/1961 | Lindstromberg et al. | 62/340 |
| 3,241,569 | 3/1966 | Sully et al. | 251/54 X |
| 3,730,215 | 5/1973 | Conery et al. | 137/494 |
| 3,732,889 | 5/1973 | Conery et al. | 137/498 |
| 3,779,273 | 12/1973 | Stone et al. | 251/23 X |

*Primary Examiner*—William E. Wayner
*Assistant Examiner*—William E. Tapolcai, Jr.
*Attorney, Agent, or Firm*—Frank P. Giacalone; Frederick P. Weidner

[57] ABSTRACT

A fluid supply system wherein a first valve is controlled to deliver a predetermined amount of fluid in series flow arrangement with a second flow valve which is automatically actuated by said fluid flow to terminate the flow of fluid after a predetermined quantity of fluid flow in the event the first valve does not terminate the flow of fluid after the preselected amount of fluid is delivered.

12 Claims, 2 Drawing Figures

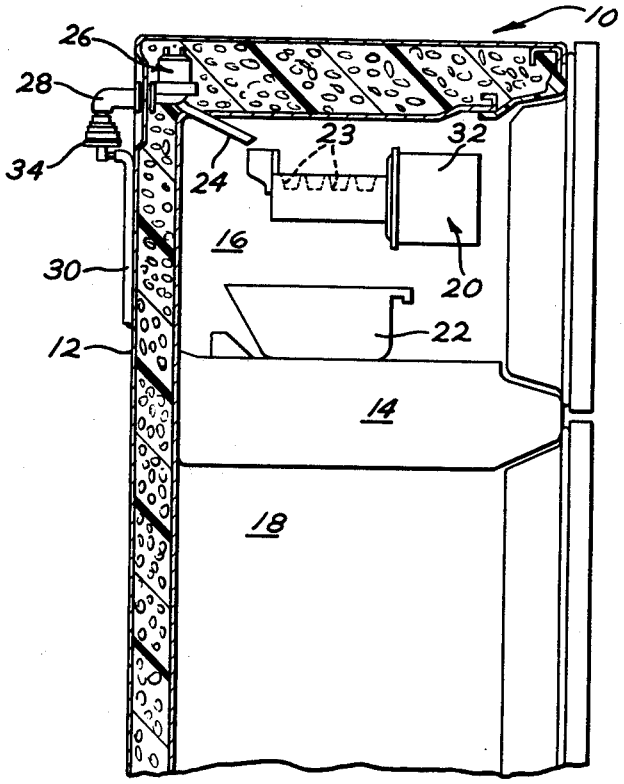
FIG. 1
FIG. 2
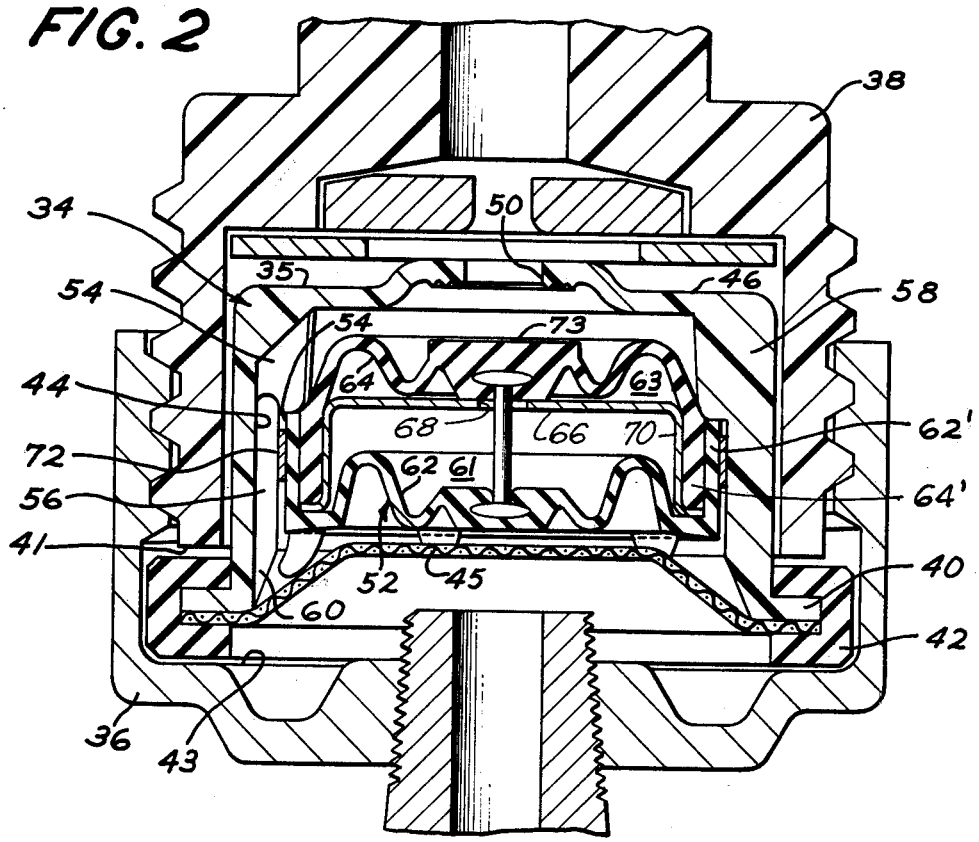

FLUID SUPPLY SYSTEM FOR A DOMESTIC APPLIANCE

BACKGROUND OF THE INVENTION

This invention relates to a fluid supply system for a domestic appliance and more particularly to a system for providing a predetermined amount of fluid during each cycle of operation. In applying a supply system as for example to a domestic refrigerator and more specifically to an automatic ice maker it is necessary that only the amount of fluid or water required to fill the ice molds or cavities is supplied. To accomplish this many prior art controls are employed to meter the supply of water. In many instances an electrically energized water valve is employed that is activated for a specific period of time during an ice making cycle as by a timing device or cam associated with the ice harvesting mechanism. This type of timing arrangement is satisfactory especially when used in combination with a flow control or metering system that compensates for varying pressure supply flows.

A problem, however, arises when there is a malfunction that prevents the valve from effectively shutting off the flow of water at the selected time. The malfunction can be the fault of the valve and/or its associated mechanism. It can also be a malfunction of the timer mechanism or its associated electrical components. In any event the failure of the water supply being terminated can result in substantial water damage to the surrounding environment if not remedied within a reasonable amount of time.

One approach is to employ two valves in series within one valve body in hopes that only one will fail with the other providing adequate protection.

Another approach has been to provide a solenoid coil which burns out and allows the valve to shut off if it is energized for more than a predetermined length of time. While these approaches offer solutions in some instances they do not solve the problems associated with valves that will not mechanically close because of contaminators in the supply system that prevent valve shut off, or in the case where the valve is functioning normally but the flooding condition is a result of a leak in the system.

SUMMARY OF THE INVENTION

A fluid supply system for delivering a predetermined amount of fluid including a first valve operable for controlling the amount of fluid delivered by the first valve.

A second valve is arranged in series flow relationship with the first valve. The second valve is operable by the fluid supply independent of the first valve for terminating the fluid flow when the first valve delivers more than the predetermined amount of fluid.

The second valve includes an inlet and outlet and a valve member operable by the flow of fluid being arranged in cooperating relationship with the outlet. A passageway bypassing the valve member allows fluid flow between the inlet and outlet.

The passageway is dimensioned to provide a pressure differential between the inlet and outlet that is sufficient to allow the fluid flow to move the valve member at a preselected rate thereby moving the valve portion into engagement with the outlet to stop the flow of fluid in the supply system after a predetermined period of time.

BRIEF DESCRIPTION OF THE DRAWINGS

FIG. 1 is a partial side elevational view of a refrigerator showing the supply system incorporating the present invention; and FIG. 2 is a sectional view showing the shut off valve assembly of the present invention.

DESCRIPTION OF THE PREFERRED EMBODIMENT

Referring now to the drawings there is shown one embodiment of the present fluid supply system as it is applied to a household refrigerator and more particularly to the water supply system of an automatic ice maker housed in the refrigerator. It should be noted at this time that the present system may be effectively applied to other domestic appliances that require specific amounts of water, such as, automatic dishwashers and clothes washers.

While the invention may be applicable to other appliances, it will be particularly described with reference to a refrigerator as shown in FIG. 1 of the drawing. The refrigerator 10 includes a cabinet structure 12 divided by a partition 14 into a freezer compartment 16 and a fresh food compartment 18.

The freezer compartment 16 contains an automatic ice maker generally indicated by the numeral 20 from which ice pieces are periodically discharged into a storage receptacle 22. The ice maker 20 may be any of the well known commercially available types, all of which have in common an operating sequence which includes the steps of introducing a predetermined amount of water into a plurality of mold cavities 23, freezing this water into ice, discharging the ice pieces to the storage receptacle, followed by the supplying of a fresh predetermined amount charge of water to the ice maker mold.

As has been previously indicated, the household refrigerators presently available with automatic ice makers, are designed to be "plumbed in" or in other words connected to the high pressure household water supply line. The water from which the ice bodies or pieces are formed is delivered to the mold by means of an inlet 24 connected to a solenoid operated valve 26 by a delivery tube 28. The valve 26 is connected to a suitable source of water under pressure by the inlet or supply line 30. To start the ice making cycle the solenoid valve 26 is energized for a predetermined length of time so that it delivers only enough water to fill the ice mold to a predetermined level. The length of time the valve 26 is energized is generally programmed in the control portion 32 of the ice maker 20. When the amount of water delivered is a function of time, the valve 26 may be provided with a flow control that compensates for any pressure variation in the water supply.

In accordance with the present invention, there is provided a new and improved water supply system that will effectively terminate the flow of water into the ice maker molds in the event solenoid valve 26 for any reason fails to cut off the supply of water.

The means for cutting out the supply of water to the ice maker is a shut off valve 34 which is arranged in the supply line 30 in series flow with the valve 26. Referring now to FIG. 2 of the drawing. The valve 34 as will be hereinafter explained in detail provides an anti-flooding system when employed in series flow arrangement with the solenoid valve 26 since it will shut off the water supply if appreciably more water than needed to fill the ice maker molds should flow during the period required for a normal complete ice maker fill cycle. More importantly by the present invention the water supply will be shut off after a predetermined amount of time at a selected fluid flow rate regardless of the reason for the extended water flow condition. The shutting off of water supply is a function of time the water is flowing and is independent of the ice filling cycle and valve 26.

The valve 34 is dimensioned to be housed in a standard off-the-shelf coupling system which usually includes a female member 36 and a male member 38 and, as will be explained hereinafter, may be installed in the field as an add-on. In the present instance female member 36 is connected to the water supply source or line 30 while the male portion 38 is connected to the conduit 28 leading to ice maker fill valve 26. The valve 34 includes a casing 35 that is dimensioned to fit into the recesses or inlet portion of the male member 38 and is provided with a flange 40 which acts as a means of axially positioning the valve 34 in male member 38. The flange 40 is sandwiched between a resilient sealing member 42 that engages the open or free end 41 of portion 38 and the bottom or base wall 43 of member 36 to function as a sealing gasket between the members 36 and 38. Also trapped by sealing member 42 is a screen 45 which prevents impurities from passing into the passageway 56.

The casing 35 of valve 34 includes a cylindrical wall 44 and a tranverse or bottom wall 46 integrally formed to the wall 44 to define a generally cup-shaped configuration with the open end defined by flange 40 providing an inlet 48. An outlet 50 is arranged in the wall 46.

Arranged in the cup portion or recess of casing 35 formed by cylindrical wall 44 and wall 46 is a damping valve member 52 which as will be explained operates to close outlet 50. The valve member 52 is dimensioned so that its outer circumferential wall 54 is spaced from the inner wall portion of wall 44 so that a passageway 56 is provided between the inlet 48 and outlet 50. Formed integral with the casing 35 are a series of circumferentially spaced locating portions 58 on which the valve member 52 is arranged so as to be axially spaced relative to the outlet 50. Also formed integral with the casing 35 are a series of longitudinally arranged ribs or portions 60 projecting inwardly from the wall 44 to centrally locate the valve member 52. The passageway 56 is in fact that portion as defined between the portions 58 and 60. With the valve member 52 so arranged in the casing 35 the passageway 56 is dimensioned as will be explained hereinafter to provide a predetermined pressure drop between the inlet 48 and outlet 50.

Referring now to the form of damping device shown in the present embodiment it will be observed that the same includes a pair of resilient bellows sections 62 and 64 each of which have their outer peripheral ends 62' and 64' respectively in sealed connection with a central member 66. The central member 66 forms a dividing wall between chambers 61 and 63 of the bellows section 62 and 64 respectively. The central member 66 is provided with a calibrated liquid orifice 68 within the bellows sections 62 and 64 to allow communication between the chambers 61 and 63. It will be seen also that the central member 66 is provided with a wall 70 with the ends 62' and 64' being trapped between wall 70 and a retaining ring 72 to completely seal the chambers 61 and 63 of the bellows sections.

The area within the bellows sections 62, 64 defined by chambers 61 and 63 in the present embodiment was filled with an oil having a viscosity of 10,000 centipoise. Further the bellows sections are secured at a spaced-apart relationship by a rod or connecting member 74 so that they move together. The bellows section 64 is provided with a centrally arranged valve portion 73 which cooperates with outlet 50 to shut off the flow of water.

The purpose of the calibrated orifice 68 is to delay movement of the bellows sections. That is to say that when the valve portion 52 tends to move toward the outlet 50 under action of the water pressure drop across the passageway 56, it cannot do so freely owing to the resistance offered by the oil contained in the chamber 61 of bellows section 62 which must be forced through orifice 68 in order to pass into the chamber 63 of bellows section 64.

As a result of the throttling action of the oil through the calibrated orifice 68 the movement of valve portion 52 is damped to an extent which may be varied within wide limits by the proper choice of the calibrated orifice 68 and passageway 56, as well as the diameter of the bellows sections 62 and 64 and the viscosity of the oil employed in the bellows sections.

In the operation of the automatic ice making cycle the water supply system solenoid 26 is energized through the control 32 and is timed to deliver the required amount of water to the ice molds which normally takes 6 seconds. At the same instance water flow starts through the system to fill the ice molds 23 the pressure drop in the water flow through the passageway 56 starts moving the valve portion of the bellows section 62, 64 toward the outlet 50 as the oil is driven through orifice 68 of central member. The pressure drop is such however that before closure of outlet opening 50 by valve portion takes place the ice molds will be filled and the solenoid de-energized. At this point with the pressure drop equalized as water flow stops the bellows section will return to their normal position as shown.

However, let's assume that for any of a variety of reasons the solenoid valve does not stop water flow, in this instance the bellows sections will continue to move and after the pre-selected time delay which in the present instance is 30 seconds the valve portion will contact outlet 50 and shut down the flow of water thereby preventing possible extensive damage.

It should be noted that in this emergency situation once valve 34 shuts off the water supply it will remain off since the bellows will be held by water pressure in this position until the line is broken and pressure released.

In summary there is provided by the present invention a water supply shut off system that will effectively shut off the flow of water if the flow does not terminate in a predetermined period of time. It should be noted that the valve 34 may be dimensioned to provide a cut off of water supply over a wide range of time requirements and water pressure situations. The feature of remaining closed once closed in an emergency situation requires that a service man be called. The cause of the malfunction is then determined and corrected.

It should be apparent to those skilled in the art that the embodiment described heretofore is considered to be presently preferred form of this invention. In accordance with the Patent Statutes, changes may be made in the disclosed apparatus and the manner in which it is used without actually departing from the true spirit and scope of this invention.

What is claimed is:

1. A fluid supply system for terminating fluid flow after delivering a predetermined amount of fluid comprising:

a first valve means;

control means operable for controlling the amount of fluid delivered by said first valve means;

a second valve arranged in series flow relationship with said first valve operable by said fluid supply independent of said first valve control means for terminating said fluid flow when said first valve means delivers more than said predetermined amount of fluid;

said second valve including an inlet and outlet;

a valve member having first and second resilient portions arranged to form a sealed chamber being isolated from said fluid flow, said valve member including a central member having an opening therein, a liquid in said chamber for causing said valve portions to move relative to said central portion and said outlet, said second portion arranged in cooperating relationship with said outlet;

means providing a passageway bypassing said valve member for allowing fluid flow between said inlet and outlet;

said passageway being dimensioned to provide a pressure differential between said inlet and outlet sufficient to cause said fluid supply to move said liquid in said chamber through said opening in said central member to cause said valve member to move at a preselected rate thereby moving said second valve portion into engagement with said outlet and to stop the flow of fluid in said supply system after passing a predetermined quantity of fluid.

2. The fluid supply system recited in claim 1 wherein said second valve includes a casing having a cylindrical wall and a transverse wall integrally joined to define a generally cup-shaped configuration with the open end providing an inlet and a substantially centrally arranged outlet in said transverse wall, a valve member arranged in said casing having a valve portion movable with said valve member.

3. The fluid supply system recited in claim 2 wherein said control means is operable for causing said valve to open for a selected period of time sufficient to deliver a predetermined amount of fluid and to cause said valve to close after said selected period of time.

4. A fluid supply system for delivering a predetermined amount of fluid comprising:

a first valve means;

control means operable for controlling the amount of fluid delivered by said first valve means;

a second valve arranged in series flow relationship with said first valve operable by said fluid supply independent of said first valve control means for terminating said fluid flow when said first valve means delivers more than said predetermined amount of fluid;

said second valve including a casing having a cylindrical wall and a transverse wall integrally joined to define a generally cup-shaped configuration with the open end providing an inlet and a substantially centrally arranged outlet in said transverse wall;

a valve member responsive to said fluid flow arranged in said casing having, (a) a central member including a port, (b) upstream and downstream bellows section having their opposite end portions respectively in sealed connection with the central member so that said central member including said port is within the bellows section, (c) liquid within the opposite bellows sections movable through said port from one bellows section to the other, (d) a valve portion arranged on said downstream bellows section arrnged in cooperating relationship with said outlet;

means providing a passageway bypassing said valve member for allowing fluid flow between said inlet and outlet;

said passageway being dimensioned to provide a pressure differential between said inlet and outlet sufficient to allow said fluid supply to move said upstream bellows section toward said central member to force said liquid through the port into the downstream bellows section at a preselected rate thereby moving said valve portion into engagement with said outlet to stop the flow of fluid in said supply system after a predetermined period of time.

5. The invention recited in claim 4 wherein said supply system includes a coupling upstream of said first valve, said coupling including a male member having circumferentially disposed wall forming a recess, a female member for threadingly receiving said male member to form a fluid tight connection, said casing being dimensioned to be received in said male member recess so as to be positioned in said coupling.

6. The invention recited in claim 5 wherein a flange is provided extending radially outwardly from said open end of said cylindrical wall of said casing to a position overlying the open end of said circumferentially arranged wall, a resilient member positioned on said flange providing sealing means between the open end of said circumferentially arranged wall of said male member and said female when said members are threadedly engaged.

7. In a refrigerator having a fresh food compartment, a freezer compartment, an automatic ice maker arranged in said freezer compartment, a fluid supply system for delivering a predetermined amount of fluid to said ice maker, including:

a first valve means;

control means operable for controlling the amount of fluid delivered by said first valve means;

a second valve arranged in series flow relationship with said first valve operable by said fluid supply independent of said first valve control means for terminating said fluid flow when said first valve means delivers more than said predetermined amount of fluid;

said second valve including an inlet and outlet;

a valve member having first and second resilient portions arranged to form a sealed chamber being isolated from said fluid flow, said valve member including a central member having an opening therein, a liquid in said chamber for causing said valve portions to move relative to said central portion and said outlet said second portion arranged in cooperating relationship with said outlet;

means providing a passageway bypassing said valve member for allowing fluid flow between said inlet and outlet;

said passageway being dimensioned to provide a pressure differential between said inlet and outlet sufficient to cause said fluid supply to move said liquid in said chamber through said opening in said central member to cause said valve member to move at a preselected rate thereby moving said second valve portion into engagement with said outlet and to stop the flow of fluid in said supply system after passing a predetermined quantity of fluid.

8. The fluid supply system recited in claim 7 wherein said second valve includes a casing having a cylindrical wall and a transverse wall integrally joined to define a generally cup-shaped configuration with the open end providing an inlet and a substantially centrally arranged outlet in said transverse wall, a valve member arranged in said casing having a valve portion movable with said valve member.

9. The fluid supply system recited in claim 8 wherein said control means is operable for causing said valve to open for a selected period of time sufficient to deliver a predetermined amount of fluid and to cause said valve to close after said selected period of time.

10. In a refrigerator having a fresh food compartment, a freezer compartment, an automatic ice maker arranged in said freezer compartment, a fluid supply system for delivering a predetermined amount of fluid to said ice maker, including, a first valve means;

control means operable for controlling the amount of fluid delivered by said first valve means;

a second valve arranged in series flow relationship with said first valve operable by said fluid supply independent of said first valve control means for terminating said fluid flow when said first valve means delivers more than said predetermined amount of fluid;

said second valve including a casing having a cylindrical wall and a transverse wall integrally joined to define a generally cup-shaped configuration with the open end providing an inlet and a substantially centrally arranged outlet in said transverse wall;

a valve member responsive to said fluid flow arranged in said casing having, (a) a central member including a port, (b) upstream and downstream bellows section having their opposite end portions respectively in sealed connection with the opposite faces of the central member so that said central member including said port is within the bellows section, (c) liquid within the opposite bellows sections movable through said port from one bellows section to the other, (d) a valve portion arranged on said lower bellows section arranged in cooperating relationship with said outlet;

means providing a passageway bypassing said valve member for allowing fluid flow between said inlet and outlet;

said passageway being dimensioned to provide a pressure differential between said inlet and outlet to allow said fluid supply to move said upper bellows section toward said central member to force said liquid through the port into the lower bellows section at a preselected rate thereby moving said valve portion into engagement with said outlet to stop the flow of fluid in said supply system after passing a predetermined quantity of fluid.

11. The invention recited in claim 10 wherein said supply system includes a coupling upstream of said first valve, said coupling including a male member having circumferentially disposed wall forming a recess, a female member for threadingly receiving said male member to form a fluid tight connection, said casing being dimensioned to be received in said male member recess so as to be positioned in said coupling.

12. The invention recited in claim 11 wherein a flange is provided extending radially outwardly from said open end of said cylindrical wall of said casing to a position overlying the open end of said circumferentially arranged wall, a resilient member positioned on said flange providing sealing means between the open end of said circumferentially arranged wall of said male member and said female when said members are threadedly engaged.

* * * * *